United States Patent [19]

Fradin

[11] 4,231,135

[45] Nov. 4, 1980

[54] FLEXIBLE AND SEWABLE HINGE

[76] Inventor: Raymond Fradin, 2006 Navy St., Santa Monica, Calif. 90405

[21] Appl. No.: 34,626

[22] Filed: Apr. 30, 1979

[51] Int. Cl.[3] ..... E05D 3/02; E05D 5/02

[52] U.S. Cl. ..... 16/150; 16/169

[58] Field of Search ..... 16/150, DIG. 13, 128.1, 16/176, 169

[56] References Cited

U.S. PATENT DOCUMENTS

| | | | |
|---|---|---|---|
| 3,390,420 | 7/1968 | Foltz | 16/169 |
| 4,141,486 | 2/1979 | Nilsen | 16/150 X |

FOREIGN PATENT DOCUMENTS

| | | | |
|---|---|---|---|
| 2235134 | 2/1974 | Fed. Rep. of Germany | 16/DIG. 13 |
| 728035 | 12/1966 | Italy | 16/DIG. 13 |

*Primary Examiner*—Wm. Carter Reynolds

*Attorney, Agent, or Firm*—Gerald L. Price

[57] ABSTRACT

A hinge with two elongated flexible flange portions which can be fastened to an article by sewing or stapling. Each flange portion includes a plurality of integral aligned knuckles which engageably cooperate with the knuckles in the other whereby a pin can be passed through the knuckles of each flange portion forming an elongated hinge.

5 Claims, 8 Drawing Figures

FLEXIBLE AND SEWABLE HINGE

BACKGROUND OF THE INVENTION

The present invention relates to elongated hinges of the type generally referred to as piano hinges and more particularly to an improved hinge which can be readily attached to either flexible or rigid material by sewing or stapling.

In the cushion, furniture and upholstery manufacturing industry, it is often desired to connect a plurality of cushions together in a hinged relationship or to hinge a cushion to a rigid frame portion of a piece of furniture. This was often accomplished by connecting the two pieces with a section of fabric material which was either a continuation of the fabric from the cushions, or sewn to one of the cushions. The primary difficulty with this method is that the handling of two or more joined cushions while sewing them together is extremely difficult. Additionally, this method does not permit the joined cushions to be separated for cleaning or storage.

As an attempt to solve the aforestated problem, some manufacturers utilized a cloth and metal or cloth and plastic zipper as a hinge member for connecting two cushions with the cloth portions being sewn to each cushion. While this method simplified sewing and permitted detachment of cleaning and storage, the zipper mechanism was found not to be able to withstand repeated folding or excessive strain and would usually fail in a short amount of time.

SUMMARY OF THE INVENTION

Accordingly, it is the general aim of the present invention to provide a new and improved elongated flexible hinge which is lightweight, reliable, simple to separate, and which can be readily sewn to fabric or other flexible material or fastened to a rigid material by conventional fastening methods such as staples, screws, tacks or adhesive.

While the present invention is concerned with the provision of a new and improved flexible, sewable, and detachable hinge, it is nevertheless, an object of the invention to provide an improved hinge which is made of a minimum of inexpensive parts thus simplifying the manufacturing and packaging together with the use of same.

BRIEF DESCRIPTION OF THE DRAWINGS

Other objects and advantages of the present invention, along with the interrelationship between the elements of the preferred embodiment, will become more apparent when considered in connection with the specification and accompanying drawings in which.

Figure 1:
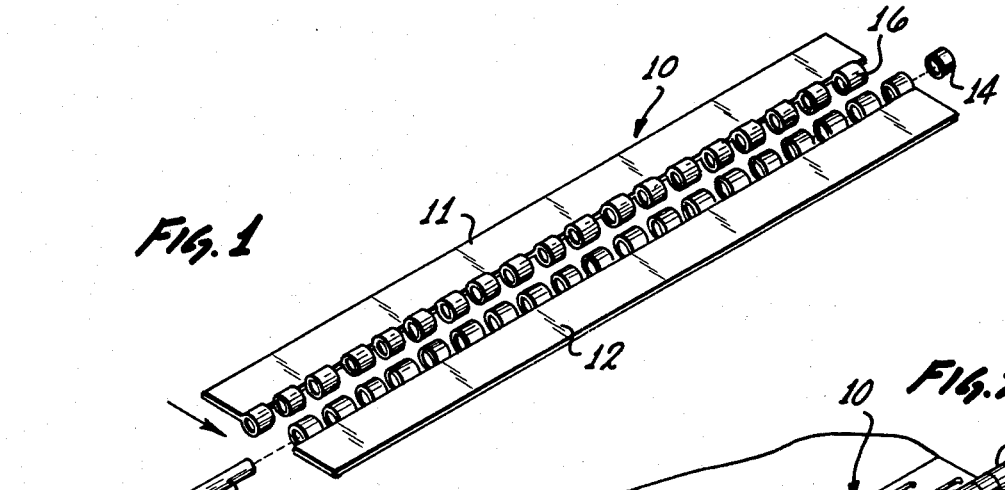
FIG. 1 is a perspective view of the components of an exemplary hinge embodying the features of the present invention.

While the present invention is susceptible of various modifications and alternative constructions and can be used with various types of materials and overall designs, illustrative embodiments have been shown in the drawings and will hereinafter be described in detail. It should be understood, however, that it is not intended to limit the invention to the particular embodiment disclosed, but, on the contrary, the intention is to cover all equivalents and alternative constructions falling within the spirit and scope of the invention as expressed in the appended claims.

DESCRIPTION OF THE PREFERRED EMBODIMENT

Figure 2:
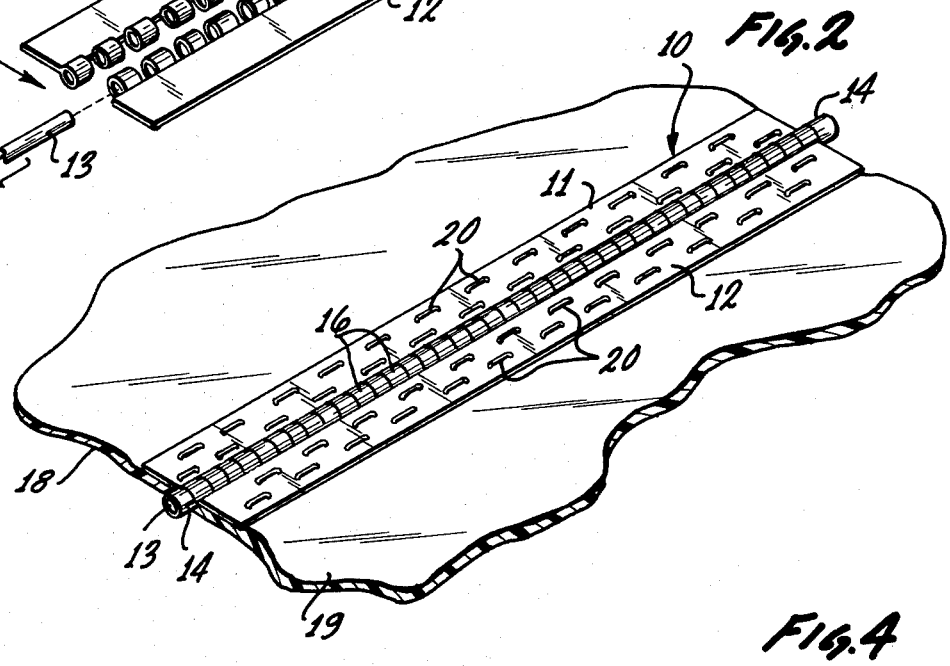
FIG. 2 is a perspective view of the hinge illustrated in FIG. 1 in assembled form and attached by sewing to two pieces of flexible material.
Figure 3:
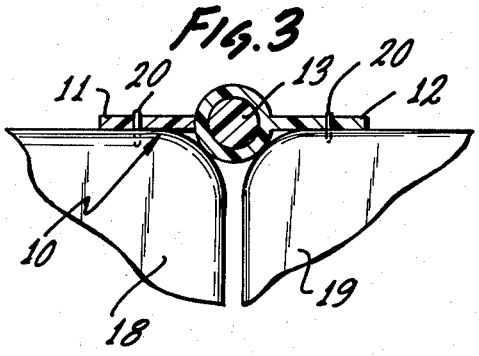
FIG. 3 is a section of the hinge illustrated in FIG. 1 showing it being utilized to attach two cushions together and also depicting a reinforcing rod inserted in a tubular hinge pin for rigidity.

Referring now to FIGS. 1 through 3, an exemplary hinge generally indicated at 10, is illustrated, the hinge including two flange portions 11 and 12, a pin 13, and a pair of pin retainers 14. Each flange portion includes one edge comprised of a plurality of cylindrical and hollow knuckles 16 which are intregally formed with each flange and as shown in FIGS. 1 and 3, the knuckles on each flange are spaced to receive the knuckles 16 from the other flange in an aligned relationship.

In order to hold the two flanges 11 and 12 together to form a complete hinge, pin 13 is provided to be inserted through the aligned knuckles 16 of flanges 11 and 12 as depicted in FIGS. 11 and 12. A piece of resilient tubing 14 is provided to snuggly slip over each end of the pin 13 thereby retaining it.

In accordance with one of the important aspects of the present invention, provision is made for being able to readily attach either or both of the flanges 11 and 12 of the hinge 10 to flexible material such as fabric by sewing. This is accomplished by fabricating each flange 11 and 12 out of a flexible and relatively thin and resilient material such as vinyl plastic which can be readily sewn as shown at 20 in FIG. 3. In many applications such as connecting pillows and cushions, it is often desireous to sew the flanges 11 and 12 into their respective cushions before connecting them into a hinge with rod 13.

Figure 4:
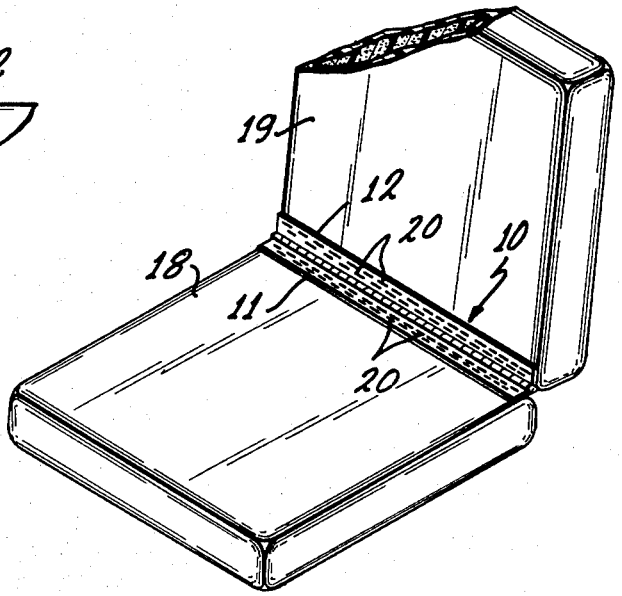
FIG. 4 is a perspective view of two cushions joined together by the hinge illustrated in FIGS. 1 through 3.
Figure 5:
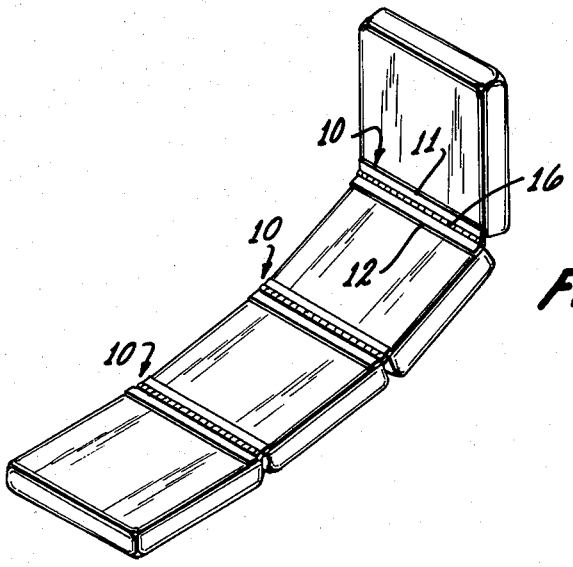
FIG. 5 is a perspective view of a plurality of cushions joined together by hinges of the type illustrated in FIG. 1.
Figure 6:
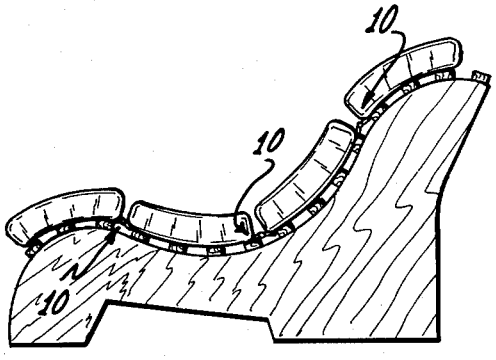
FIG. 6 is a side elevation of an exemplary piece of contour furniture showing how the hinges joined by the cushions of FIG. 5 enable the cushions to conform to the contour of same.
Figure 7:
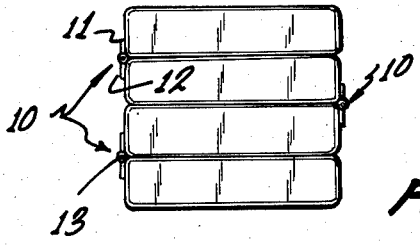
FIG. 7 is a side elevation of a plurality of cushions joined by hinges of the type illustrated in FIG. 1 illustrating how said hinges enable the cushion to be stacked for storage.
Figure 8:
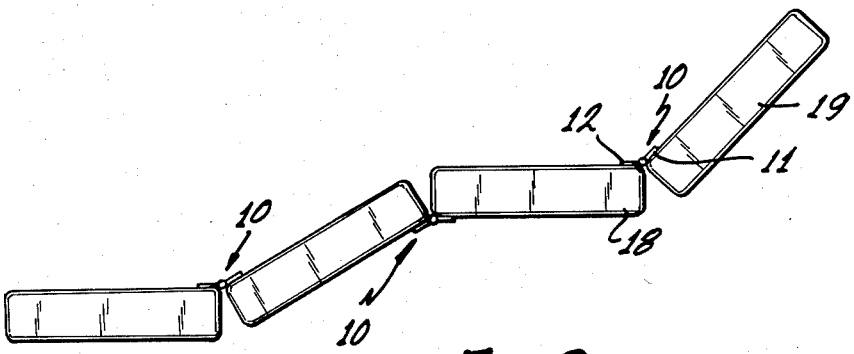
FIG. 8 is a side elevation of the hinged cushions shown in FIG. 7, but here shown unfolded into a contour configuration.

As shown in FIGS. 3 and 4, once the flanges 11 and 12 are fastened to separate cushions 18 and 19 by sewing and connected, the cushions are hinged to one another. As shown in FIGS. 5 and 6 a plurality of pillows and cushions can be joined to conform to a particular contour. If the hinges 10 are staggered on opposite sides as shown in FIGS. 7 and 8, the cushions when attached with the fully assembled hinges 10 can assume a contour (FIG. 8) and also compactly fold for storage (FIG. 7).

While flexible hinges have been known in the prior art such as U.S. Pat. No. 2,484,581 to W. B. Pallmen, such construction requires both hinge flanges to be substantially bent for attachment which could not be accomplished in many situations where either or both flanges are attached. Additionally, the hinge 10 of the present invention can be fabricated from continuously formed extrusions and therefore can be provided in any desired length without special tooling or fixtures for each desired size.

In fabricating the hinge 10 of the instant invention, the flanges 11 and 12 are continuously extruded in a flexible and pliable material such as previously pointed out, vinyl plastic. In the extruded flange, the portion which defines the knuckles 16 in the finished hinge 10, are formed as a continuous tube and the flange is then subjected to a cutting or notching operation which by the removal of selected material forms the spaced knuckles 16. The aforestated cutting or notching operation can be accomplished in a continuous operation thereby allowing the exemplary hinge 10 of the present invention to be produced in high volume at a relatively low manufacturing cost.

In the exemplary construction described herein, it is contemplated that the hinge pin 13 will comprise a flexible and pliable extrusion having a tubular section. For applications where additional rigidity and strength are desired, it has been found that the insertion of a solid rod of a generally flexible material through the entire length of the center opening of hinge pin 13, shown as 13a in FIG. 3 will impart a significant increase in strength and rigidity to the hinge structure described herein.

By utilizing flexible and pliable plastic in the construction of all of the components of the hinge, an additional benefit of user comfort is achieved, which is another important feature not found in the prior art.

Having thus described my invention, I claim:

1. A flexible and sewable hinge comprising: a pair of elongated generally flat flanges of a resilient, flexible and pliable material, an aligned series of evenly spaced tubular cylindrical knuckles formed integrally with one elongated edge of each said flange with the spacing of the knuckles in the second flange to be inserted into the spaces between the knuckles in the first flange whereby upon such insertion, the tubular portion of all of the knuckles in both of said flanges are in an aligned relationship, a flexible and pliable hinge pin with a tubular cross section and sized to be inserted through the tubular portion of all of said knuckles of both flanges when they are in said aligned relationship, means for retaining said pin in the aforestated position, and an elongated rod sized to be slideably inserted substantially through the entire tubular center of said hinge pin.

2. The apparatus as set forth in claim 1 wherein said flanges are a plastic material.

3. The apparatus as set forth in claim 1 wherein said flanges are thin vinyl plastic of which the said flat portion thereof is readily penetratable by the needle from a conventional sewing machine.

4. The apparatus as set forth in claim 3 wherein said hinge pin is a plastic material.

5. The apparatus as set forth in claim 1 wherein said elongated rod is a flexible, pliable plastic material.

* * * * *